United States Patent [19]

Jaecklin

[11] 4,293,245

[45] Oct. 6, 1981

[54] STRUCTURAL SYSTEM AND STRUCTURAL ELEMENTS FOR USE AND CONSTRUCTION OF EARTH FILLED WALLS

[76] Inventor: Felix P. Jaecklin, Geissbergstrasse, 59, 5400 Ennetbaden, Switzerland

[21] Appl. No.: 46,847

[22] Filed: Jun. 8, 1979

[30] Foreign Application Priority Data

Jun. 13, 1978 [CH] Switzerland ..... 6411/78
Nov. 21, 1978 [CH] Switzerland ..... 8313/78

[51] Int. Cl.[3] ..... E02D 5/00

[52] U.S. Cl. ..... 405/272; 405/284; 405/273

[58] Field of Search ..... 405/272, 273, 274, 284, 405/285, 15, 16

[56] References Cited

U.S. PATENT DOCUMENTS

| | | | |
|---|---|---|---|
| 1,472,917 | 11/1923 | Laird | 405/273 |
| 1,733,790 | 10/1929 | Gilman . | |
| 1,943,800 | 1/1934 | Morrison | 405/285 |
| 1,953,005 | 3/1934 | Nagel | 405/273 |
| 2,092,385 | 9/1937 | Arble | 405/273 |
| 2,149,957 | 3/1939 | Dawson | 405/273 |
| 2,301,592 | 11/1942 | Teuber | 405/16 |
| 2,828,613 | 4/1958 | Wilson | 405/273 |
| 2,972,870 | 2/1961 | Cooper . | |
| 3,198,614 | 8/1965 | Powell | 405/285 |
| 3,877,236 | 4/1975 | O'Neill et al. . | |

FOREIGN PATENT DOCUMENTS

| | | | |
|---|---|---|---|
| 77366 | 3/1949 | Czechoslovakia | 405/273 |
| 2718290 | 11/1977 | Fed. Rep. of Germany . | |
| 2513268 | 6/1978 | German Democratic Rep. . | |

*Primary Examiner*—Dennis L. Taylor
*Attorney, Agent, or Firm*—Werner W. Kleeman

[57] ABSTRACT

A system of structural elements are disclosed for the construction of earth filled walls. The structural elements of the system form a variety of matching elements according to various applications.

The present invention includes prefabricated elements as part of a structural system and walls built by the elements, as well as the use of the structural system and structural elements for the construction of walls.

27 Claims, 27 Drawing Figures

FIG. 1
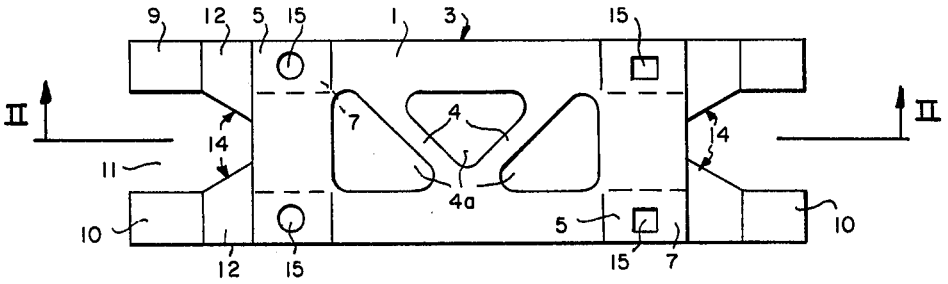
FIG. 2
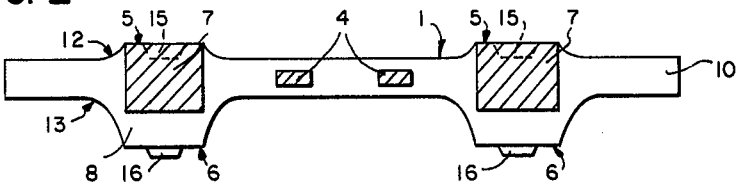
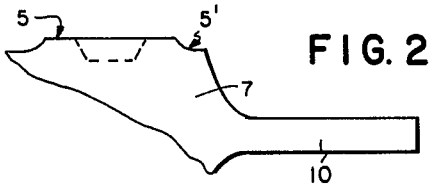
FIG. 2A
FIG. 3
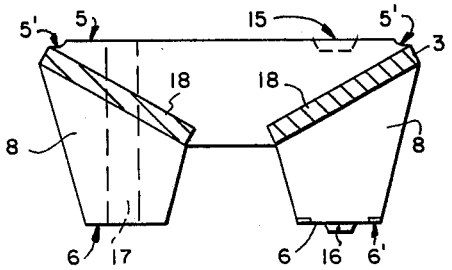
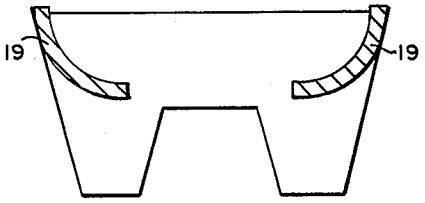
FIG. 4
FIG. 5
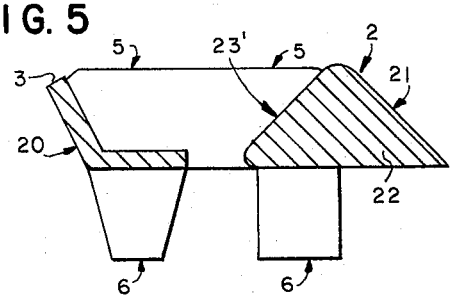
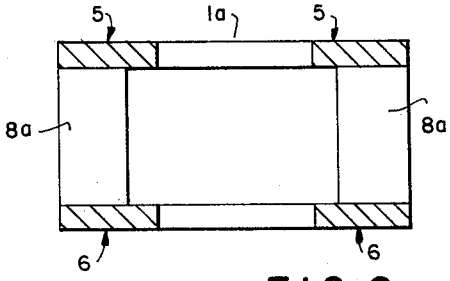
FIG. 6

FIG. 7
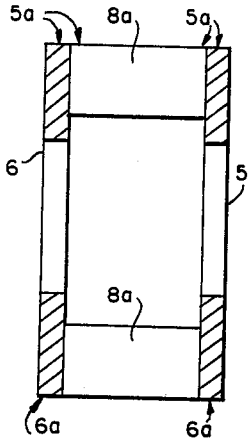
FIG. 8
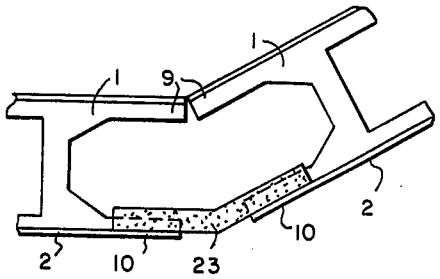
FIG. 9
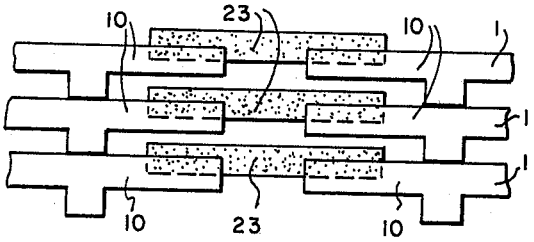
FIG. 10
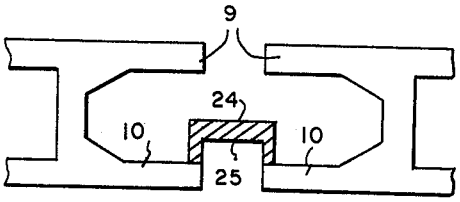
FIG. 12
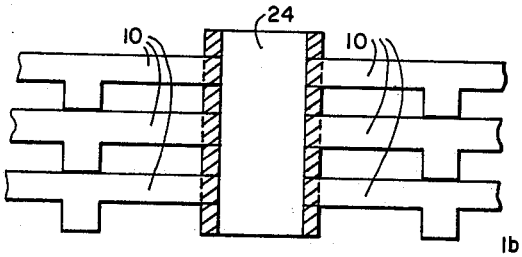
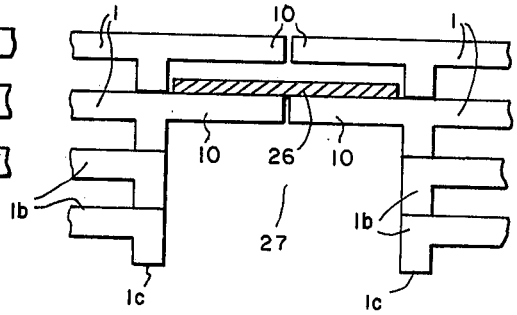
FIG. 11
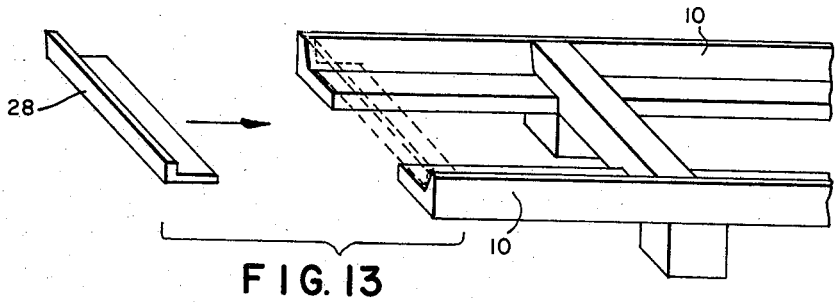
FIG. 13

FIG. 14
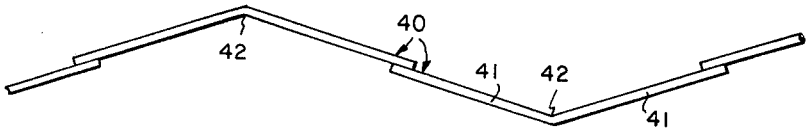
FIG. 15
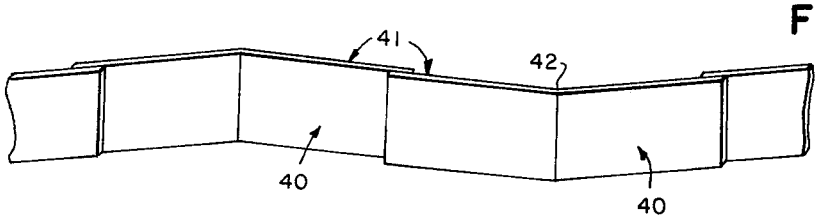
FIG. 16
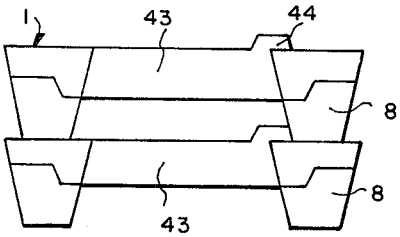
FIG. 17
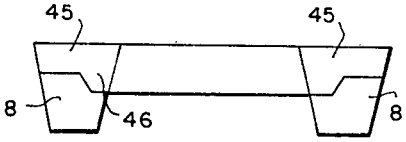
FIG. 18
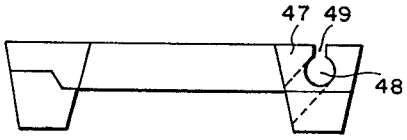
FIG. 19
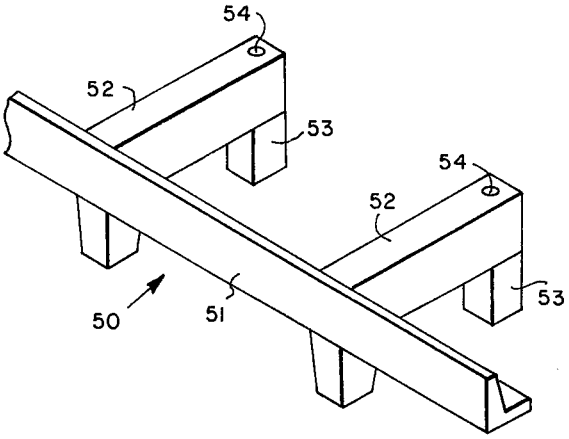
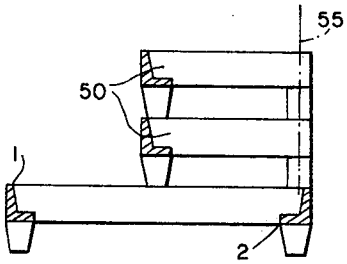
FIG. 20

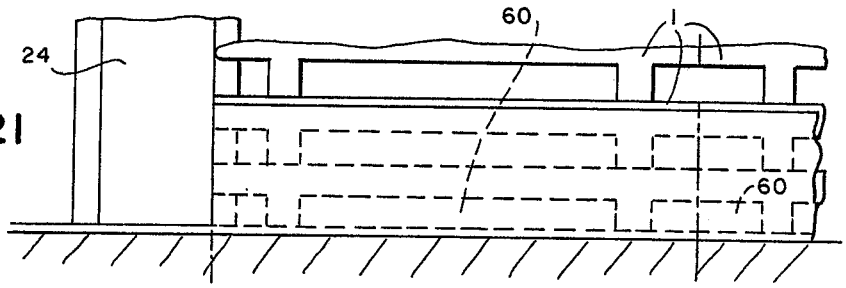
FIG. 21
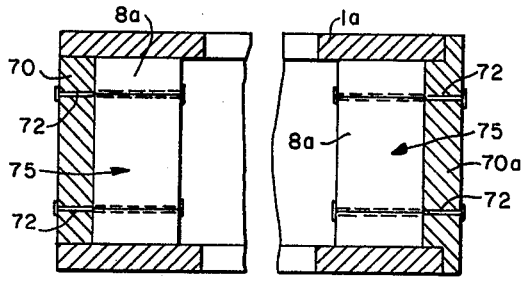
FIG. 22A
FIG. 22B
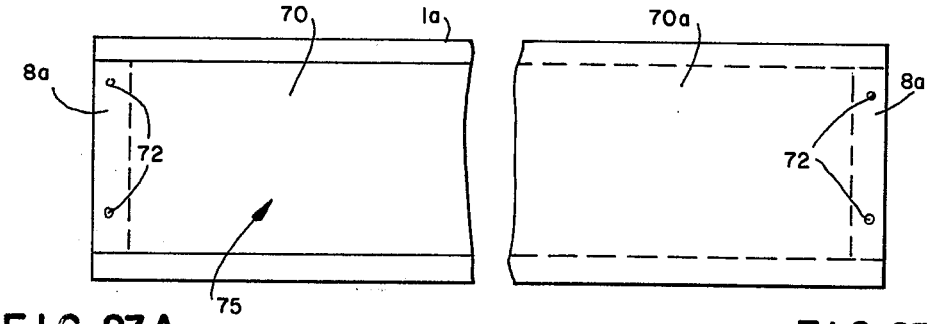
FIG. 23A
FIG. 23B
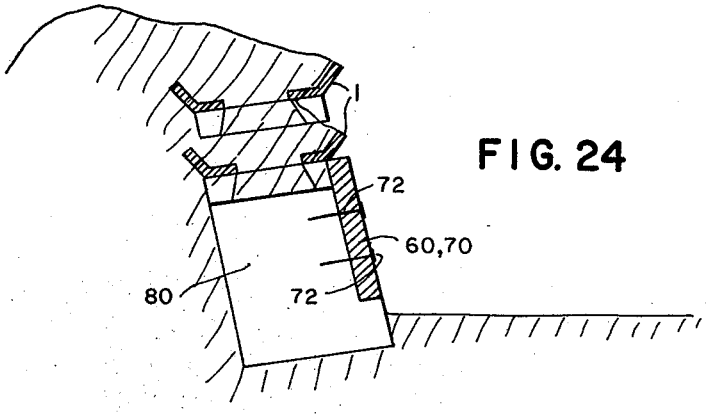
FIG. 24

STRUCTURAL SYSTEM AND STRUCTURAL ELEMENTS FOR USE AND CONSTRUCTION OF EARTH FILLED WALLS

BACKGROUND OF THE INVENTION

Structural systems for earthfilled walls are known to be framelike or slablike elements. For example such elements may consist of a longitudinal beam at front and rear and various crossing beams and prismatic elements to keep the beams appart. Such elements are placed one on top of the other and the inner space filled with earth material. Such structural elements or structural system may need improvement because the many rectangular surfaces require special equipment for concrete work or cause risks for damages during production procedures.

The idea of this invention is the improvement of structural elements or structure system of the type as described yet in a special way so that the parts that provide distance between the elements may be used yet are not mandatory, hence a simpler production procedure may result in such case.

SUMMARY OF THE INVENTION

The solution of this invention is characterized by the fact that the structural elements have at least two parallel joint planes on which the elements are stacked. Important part of such structural elements are characterized by frame or slab like form with parts of frames or slabs at least in one plane and with one support joint plane on at least one frame or slab side.

Earthfilled walls of this invention are characterized by a number of frame or slab like elements, which are piled one on top of the other and with a distance element to the next pile, so that an opening in the wall can be formed by using shorter elements below and a special bridging element at the upper end of the opening as to prevent the earthfill material from falling into the opening.

BRIEF DESCRIPTION OF THE DRAWINGS

Other characteristics and advantages of the invention are schematicly drawn in the figures.

In the drawings:

FIG. 1, shows a frame like structural element according to present invention looking from top onto the frame.

FIG. 2, shows a longitudinal section of the structural element according to cutline II—II in FIG. 1.

FIG. 2*a*, shows a detail of FIG. 2 in larger scale.

FIG. 3, shows a cross section of an other typical form of frame like element.

FIG. 4, shows an other typical cross section of frame like element according to the invention.

FIG. 5, shows a variation of the cross section with different profile of longitudinal beam on front and rear side.

FIG. 6, shows a further development of the element according to the invention in the shape of double slabs in cross section.

FIG. 7, shows the same element of the FIG. 6, yet in a 90° turned position.

FIG. 8, is a plane view on the joint of two neighbouring frame like structural elements with cantilevering beam ends and use of joining element.

FIG. 9, shows a front view of two neighbouring piles of frame like elements according to FIG. 8 and using the joining piece.

FIG. 10, is a plan view of two neighbouring frame elements with cantilevering ends using a joint piece of U-shape to forme a niche.

FIG. 11, shows a front view of the wall using the element for the niche.

FIG. 12, shows a front view of two neighbouring blocks of the wall with shorter elements below and cantilevering elements above and a bridging slab joint element.

FIG. 13, shows an isometric drawing of the cantilevering elements of frame like elements with the matching end piece.

FIG. 14, shows a plan view of a number of joining elements.

FIG. 15, shows an isometric view of such elements.

FIGS. 16 to 18, show cross sectional views of various applications of the elements.

FIG. 19, shows an isometric view of an other structural element.

FIG. 20, shows a cross section of a number of such elements according to FIG. 19.

FIG. 21, shows a front view of a wall section with various structural elements.

FIG. 22*a* and FIG. 22*b*, respectively FIG. 23*a* and FIG. 23*b*, show various aspects of the slab like structural elements for covering the end of a wall.

FIG. 24, shows a cross section through a wall with a foundation element and a covering slab element.

DETAILED DESCRIPTION OF THE PREFERRED EMBODIMENT

Refering now to FIGS. 1 and 2 using a frame like pattern with opening 4*a* and portions of the frame 4, which are essentially within the inner space of the element. The front and rear view 2 respectively 3 are formed by continuous beams within the frame system with cantilevering ends on both sides 9 and 10. The beginning of the cantilevers are formed with sloping surfaces 12 and 13 at upper and lower sides and enlarged wideness of cantilevers 14 at inner surface of cantilevers. The cantilevering end 9 and 10 form an extension of the structural element in longitudinal direction of the wall. The constructed wall built by such elements piled one on top of the other and similar piles on both sides subsequently form joint oppenings between two piles to be filled with earth material. Consequently neighbouring piles of elements are connected in a flexible way by the common earthfilling. The sloped and angled surfaces provide better resistance, yet most often are not visible from outside for better esthetic appearance. The frame type element of FIG. 1 causes good resistance of the elements, using the various openings for less weight and better filling of the wall with soil material. Furthermore the openings provide better drainage.

According to requirements shape and number of openings or size and shape of the elements may vary. Preferably one or two openings are used, yet sometimes three or more. The shape of the frame elements can be straight or curved.

As seen in FIGS. 1 and 2 the structural system 1 uses distance elements 7 and 8. Such distance elements can be part of the frame and/or added separately. Separate production or elimination brings the advantage of flat or almost flat surfaces on top or lowerside of frame element. Either way the adequate vertical distance between the frame elements can be selected as required for the earthfilling and growth of plants.

The distance elements 7, 8 form loading areas 5 and 6 for the joints between the elements piled one on top of the other.

In case of use of the structural elements as retaining walls horizontal force components are important. Normally friction resistance is sufficient if the elements are positioned in an inclined manner. Yet for certain cases loading areas 5 and 6 are provided with complementary saw teeth elements 15 and 16 to provide small holes and nobs for positive resistance against deformation of one frame element to the other parallel to the frame plane. Pyramid or cone type joining elements are advantageous. FIG. 2*a* shows distance elements 5' which goes all the way around the loading surface. The next elements matches this form exactly providing resistance in all directions. Furthermore the main vertical load transfer is better concentrated as the inner portion of the loading surfaces as to provide for less damage due to local overstress.

The cross section of a frame element according to FIG. 3 uses conical distance elements 8 with load bearing area 6 and upper load area 5, both of them without special means against sliding resistance. In such case a continuous hole 17 provides the opening that can be filled with a steel bar and mortar in order to provide continuous reinforcing from one element to the next. Yet FIG. 3 also shows the interconnection with nob 16 matching to whole 15.

The vertical opening between the frame elements as well as the horizontal opening between the distance elements result in longitudinal slots within the wall structure which provide room to see the earthfill and to grow plants, to cover the wall eventually. The shape according to FIG. 3 shows furthermore a special design of the longitudinal beams 2 and 3, using sloping surfaces 18 of the beam, especially at the lower and hence visible side. This results in better keeping the earthfilling particularly at outer edges. An even better effect in this respect results by a curved cross section of the longitudinal beams 19 according to FIG. 4 with a special esthetic and noise absorbing effect due to the convex outer surface. The shape according to FIG. 5 shows a similar effect at the inner portion of the longitudinal beams (2,3) with respect to the fill earthmaterial because of the sloping inner surface 23'. This also does not permit to hold on while trying to climb. The special slope of surface 21 and the effect to cantilevering profile of the longitudinal beam 22 result in the virtual impossibility to claim up the wall, yet still permit for some plants to grow. The cantilevering portion 22 does not allow to put a foot on the beam below. An other effect of the sloping surfaces 20 or 21 result in advantageous reflection of noise which improves the noise absorption characteristics. The conical shape of the distance elements as shown in FIG. 3 and discussed above add to this diffuse reflection of noise and therefore improve the general characteristic.

FIGS. 6 and 7 show double slab elements 1*a* with frame or slab elements in two parallel planes with upper and lower bearing surfaces 5 and 6. Both slabs can be continuous or be provided with openings as shown in FIG. 1. The double slab elements are produced in one piece preferably together with the distance elements 8*a*. Additional distance elements, similar to FIGS. one and two can eventually be used in between double slabs elements to be placed above or below load bearing areas 5 or 6. The special advantage of the double slab element of FIGS. 6 and 7 consists in simpler erection of walls and the possibility to turn the top element by 90°. This provides conditions to plant more shrubs at the top and on both sides of the element sitting on the larger elements below.

FIGS. 8 and 9 demonstrate the use of the frame like elements in a corner or bend. An additional corner joint element 23 is put between the cantilever end 10 to better close the opening joint and to follow the angle of the corner to assure earthfilling to remain in place.

FIG. 9 shows the front view of this portion of the wall as piled up to neighbouring piles. A corner joint element joins every cantilever end coming in from both sides as to provide for a continous structure. This curve element allows for better adapting retaining or noise protection walls to the given geometry of the road, yet still keep the flexible connection between neighbouring wall blocs.

FIGS. 10 and 11 demonstrates the use of a U-type element 24 providing a niche 25. The neighbouring frame elements are put in place with some distance inbetween. The element 24 covers the space and provides for the niche. The element 24 can consist of one single vertical view or a varying number of small portions. The production and erection of such niches are especially simple and advantageous for masts and fire hydrants or else.

FIG. 12 shows the opening 27 within the wall structure as sometimes required for emergency exits within noise protection walls or so. Two neighbouring blocs 1*b* and 1*c* are formed without or less cantilever portions of the frame elements at lower level (1*b*). The upper levels use regular frame type elements with cantilevers 10. However the first one above the opening uses an additional bridging slab element 26 as to prevent the earthfill from falling into the opening.

FIG. 13 shows the views of a side closing element 28 between the ends of the cantilever beams. Such side closing element provides for better appearance and inclosure of the earthfill even at the end of the wall.

FIGS. 14 and 15 show an element 40 consisting of an angle of less than 180° made of plane slab element 41. Obviously such slab elements 41 can also be curved or use a profile shape. Such element 40 is put in nearly vertical position, freestanding or even more advantageous on top of the regular earth filled wall structure. For erection the element 40 uses the same elements, yet turned around 180° as to match the next wall with some overlap. This results in a closed surface in order to heighten the retaining or noise protection wall in a simple manner. This element 40 permits the growth of plants and shrubs on either side in the niches 42.

If necessary the matching elements 40 can be connected at the overlapping. The design of the element 40 normally considers the frame length of the normal elements as to provide adequate support at the edges and connections.

According to FIG. 16 the frame elements use knobs 44 on the transverse portions to provide resistance against horizontal deformation for the next distance element 8 to be put on top of element 1. This prevents sliding in horizontal direction in simple manner.

The section of the longitudinal beams 45 in FIG. 17 uses L-type cross sections, yet the L-profile is flat on top and the vertical portion of the L 46 hangs down and is placed at the inner side of the frame element. This structure provides a particularly favorable resistance of the element and especially small surface at the front. This results in minimum production effort with very simple and flat surfaces particularly on top. Furthermore this design results in a favorable noise absorbing and esthetic appearance.

The element according to FIG. 18 uses a longitudinal canal 48 with openings 49 within the beams 47. Instead the opening 49 transverse pipes or slots of various length can be used. These openings come from top or from the side to the canal 48. The canal 48 can continue from one element to the next or join to other lines.

This system provides for prefabricated drainage within the structure of the use of the canal for cables or wires.

FIG. 19 shows element 50 with only one longitudinal beam 51 and cross beams 52. This element practically consits of only half an element as shown in FIG. 13. The cross beams 52 may be only half as long as in a regular element with two longitudinal beams 1 and 2. Accordingly there is an additional distance element 53 sometimes required, yet it can also be made by enlarging the existing distance element, or just a longitudinal beam and distance element without crossbeams at all. The distance elements 53 and the crossbeams 52 can have almost vertical openings as to provide room for vertical steel bars and mortar filling for structural reinforcing.

FIG. 20 shows the use of such wall elements on top of one or several regular elements 1, 2. The reinforcing bars are shown with line 55.

The number of additional elements form a system development for a functional use of the base element adaptable for the various practical applications. This adaptability to various needs helps by enlarge to stock and use the wall system effectively. Such structural system and elements as explained may be used for earth-filled walls, for retaining structures, noiseprotection walls, to separate certain areas or to protect weak rock-surfaces.

It is often advantageous to close the front or side openings of the wall with slab or frame like elements. Such slab element 60 is shown in FIG. 21 using a width which approximately matches the width of the element 1 according to FIG. 11. Such side or front slab accordingly forms an additional element within the structural system. Such front slab is especially useful at the lower portion of the wall or near the foundations.

FIGS. 22*a* and 23*a* on one side and FIGS. 22*b* and 23*b* one the other side demonstrate the application of an additional covering slab 70 and 70 a which match to the system at least approximately. They cover holes 75 to be filled with earth later on. The FIGS. 22*a* and 23*a* show a simple joint between the covering slab attached to element 1 and an anchor 72 to distance element 8. Similarly element 70 is attached using anchors 72 as shown in FIGS. 22*b* and 23*b*.

FIG. 24 shows another application of the covering slab 60 or 70 in the foundation area of a wall. This however requires additional elements 80 to extend the foundation. Such foundation extension can also be part of the structural system. The cover slabs are connected to the foundation elements 80 with anchors 72 as above.

The protection of the lower portion of a wall made by such elements brings advantages for particularly resistant design of walls near bottom and in case of damages through accidents or dirt. Furthermore the growth of plants near the bottom of the wall is more difficult particularly in areas with use of salt for melting snow.

I claim:

1. A structural system for the construction of walls comprising a framework consisting of solid frame elements and being filled with earth material, said frame elements extending in at least one plane and having at least one support area on at least one side, said frame elements further including at least one longitudinal beam having a cross-section with at least one portion thereof arranged at an acute angle against the main plane of the frame or slab, the upper surface thereof forming a substantially flat support for said earth material, at least one such longitudinal beam being located at the front side of said wall and having an upper front edge portion being positioned at a greater height compared with said flat support and forming a board for retaining a portion of said earth material resting on said flat support, the system further including holes extending at least partly vertically through said framework and distance elements between at least two of said frame or slab elements which are positioned one above the other such that the earth material at least partially filling said vertically extending openings forms at least one sloped surface extending at least partly through the scope between said frame or slab elements positioned one above the other.

2. The system of claim 1, wherein the said acute angle between said at least one portion of the longitudinal beam and the main plane of the frame or slab is substantially zero.

3. The system of claim 1 in which there is at least one longitudinal beam having an L-type cross-section with an upright L-portion extending upwards from said flat support portion and being positioned at the outer edge portion of the longitudinal beam, said upright L-portion being arranged at an angle relative to said main plane of the frame or slab so as to form a sloping front and/or internal surface of said board retaining the earth material, said sloping being chosen so as to form an overhang to the front side of the wall.

4. The system of claim 1 in which said at least one longitudinal beam has an at least partially arcuate cross-section.

5. The system of claim 1, having at least two frame elements stacked one upon the other, and further including a plurality of distance elements placed in between said stacked frame elements.

6. The system of claim 5, further including at least one covering slab element having a height approximately equal to the combined height of said frame and distance elements and bridging the space between said two distance elements.

7. The system of claim 6, further including at least one opening within the wall which is closed by said covering slab.

8. The system of claim 7, further including a foundation element to which said covering slab is joined.

9. The system of claim 1 further including load bearing areas that come into position only after turning the whole element by 90°.

10. The system of claim 1 having knobs 16 and matching holes 15 on at least one support area.

11. The system of claim 10 having matching holes or knobs in at least two matching support areas.

12. The system of claim 1 wherein at least one longitudinal beam of said frame or slab element has a cantilevering cross section and downward sloping outer surfaces.

13. The system of claim 1 having at least one cantilever with sloping or angular increasing cross section from the beginning of the cantilever.

14. The system of claim 1 wherein at least one element consisting of two planes is joined in an angle of less than 180°, preferably in plane slab or frame and is positioned in a way that said element stands free in an almost vertical way, joining the next element.

15. The system of claim 1 further including a knob at the transverse beam of said frame element on which said distance element of said next frame element on top touches for better shear resistance.

16. The system of claim 12 having an L-type longitudinal beam with vertical L-portion looking down.

17. The system of claim 16 wherein said downward oriented vertical L-position of the cross section is positioned at the inner side of said frame element.

18. The system of claim 12 further including a longitudinal canal in at least one longitudinal beam and including openings to the top or to the side.

19. The system of claim 18 wherein said longitudinal canals connect together and to a drainage collector.

20. The system of claim 12 wherein said frame element only consists of half of said element with subsequently reduced transverse length and only one longitudinal beam.

21. The system of claim 20 further including a distance element and a transverse beam each having an almost vertical opening.

22. The system of claim 1, having a plurality of frame elements with cantilevers and piled in blocks one on top of the other yet with a distance in between the blocks in which a joint element is positioned on the inner side of said cantilevers so that a niche is bridged.

23. The system of claim 14, wherein freestanding slab elements of angular shape in plan view join each other, preferably by overlapping.

24. The system of claim 23, wherein a plurality of slab elements firmly joined at said overlapping area.

25. The system of claim 1, wherein said system forms a noise protection or separater wall.

26. The system of claim 1, wherein said system forms a retaining structure.

27. The system of claim 1, wherein said system forms a rock protection or rock covering wall.

* * * * *